US007413099B2

(12) United States Patent
Takahashi et al.

(10) Patent No.: US 7,413,099 B2
(45) Date of Patent: Aug. 19, 2008

(54) SEALING ELEMENT WITH A PROTRUDING PART APPROXIMATELY OBLIQUELY OUTWARD AND A HERMETIC CONTAINER USING THE SAME

(75) Inventors: Masato Takahashi, Jouetsu (JP); Yoshiaki Fujimori, Itoigawa (JP); Yoshio Azuma, Arida (JP); Yasuyuki Nishimura, Arida (JP); Naohiro Horita, Arida (JP)

(73) Assignees: Shin-Etsu Polymer Co., Ltd., Tokyo (JP); Mitsubishi Cable Industries, Ltd., Hyogo (JP)

( * ) Notice: Subject to any disclaimer, the term of this patent is extended or adjusted under 35 U.S.C. 154(b) by 0 days.

(21) Appl. No.: 09/998,621

(22) Filed: Nov. 30, 2001

(65) Prior Publication Data

US 2002/0195455 A1 Dec. 26, 2002

(30) Foreign Application Priority Data

Jun. 8, 2001 (JP) ..... 2001-174401

(51) Int. Cl.

| | |
|---|---|
| ***B65D 43/04*** | (2006.01) |
| ***B65D 53/00*** | (2006.01) |
| ***F16J 15/02*** | (2006.01) |
| *B65D 85/00* | (2006.01) |

(52) U.S. Cl. ..... 220/806; 220/378; 206/710; 277/644; 277/648; 277/921

(58) Field of Classification Search ..... 220/806, 220/378, 310.1, 804, 803; 206/710, 711; 277/644, 648, 921, 626, 637, 641, 642
See application file for complete search history.

(56) References Cited

U.S. PATENT DOCUMENTS

| | | | | | |
|---|---|---|---|---|---|
| 2,528,264 | A | * | 10/1950 | Coppock et al. | 49/489.1 |
| 2,782,887 | A | * | 2/1957 | Zimmermann | 49/489.1 |
| 3,334,774 | A | * | 8/1967 | Poltorak | 220/378 |
| 3,339,934 | A | | 9/1967 | Gordon | |
| 3,578,202 | A | * | 5/1971 | Mainet | 220/378 |
| 3,640,424 | A | * | 2/1972 | Ando | 220/288 |
| 3,799,501 | A | | 3/1974 | Hartman | |
| 4,311,317 | A | | 1/1982 | Bartels | |
| 4,349,206 | A | * | 9/1982 | Simm et al. | 220/378 |
| 4,396,199 | A | * | 8/1983 | Boyd et al. | 277/637 |
| 4,447,171 | A | | 5/1984 | Baldoni et al. | |

(Continued)

FOREIGN PATENT DOCUMENTS

| | | |
|---|---|---|
| EP | 0 399 353 | 11/1990 |

(Continued)

*Primary Examiner*—Robin Hylton
(74) *Attorney, Agent, or Firm*—Darby & Darby P.C.

(57) ABSTRACT

A fit-holding groove is formed by notching the outer periphery of a door element to be fitted to close a container body. A sealing element interposed between the container body and door element is composed of an endless portion to be fitted into the fit-holding groove, a protruding part projected from the peripheral corner of the endless portion, obliquely and outwardly with respect to the open front of the container body, forming a substantially acute angle between itself and the contact surface of the open front of the container body and a pair of fitting ribs projectively formed on the obverse surface of the endless portion so as to be fitted in contact with the compartmentalized inner wall of the fit-holding portion.

4 Claims, 10 Drawing Sheets

U.S. PATENT DOCUMENTS

| | | | | | |
|---|---|---|---|---|---|
| 4,678,064 | A | * | 7/1987 | Adachi et al. | 188/73.45 |
| 4,744,570 | A | * | 5/1988 | Kranz | 277/647 |
| 4,758,004 | A | * | 7/1988 | Semon | 277/648 |
| 4,852,891 | A | * | 8/1989 | Sugiura et al. | 277/636 |
| 5,009,036 | A | * | 4/1991 | Ryan | 49/489.1 |
| 5,112,065 | A | * | 5/1992 | Meyer et al. | 277/634 |
| 5,611,452 | A | * | 3/1997 | Bonora et al. | 220/378 |
| 5,653,447 | A | * | 8/1997 | Cress | 277/312 |
| 5,971,191 | A | * | 10/1999 | Yamada et al. | 220/378 |
| 6,116,615 | A | * | 9/2000 | Trehan | 277/630 |
| 6,117,687 | A | | 9/2000 | Hugh | |
| 6,186,152 | B1 | | 2/2001 | Gueret | |
| 6,354,601 | B1 | | 3/2002 | Krampotich et al. | |
| 6,364,152 | B1 | * | 4/2002 | Poslinski et al. | 220/788 |
| 6,474,474 | B2 | * | 11/2002 | Hyobu et al. | 206/711 |

FOREIGN PATENT DOCUMENTS

| | | |
|---|---|---|
| EP | 0 757 152 | 2/1997 |
| JP | 46-36225 | 12/1971 |
| JP | 57-34141 | 7/1982 |
| JP | 58-82366 | 6/1983 |
| JP | 58-156648 | 10/1983 |
| JP | 59-762 | 1/1984 |
| JP | 2-73151 | 6/1990 |
| JP | 4-16025 | 2/1992 |
| JP | 4-30128 | 7/1992 |
| JP | 06-078851 | 3/1994 |
| JP | 7-48200 | 11/1995 |
| JP | 08-266411 | 10/1996 |
| JP | 10-120043 | 5/1998 |
| JP | 10-192145 | 7/1998 |
| JP | 11-189267 | 7/1999 |
| JP | 11-299646 | 11/1999 |
| KR | 2000-0012921 | 3/2000 |
| KR | 2000-0021473 | 4/2000 |

* cited by examiner

SEALING ELEMENT WITH A PROTRUDING PART APPROXIMATELY OBLIQUELY OUTWARD AND A HERMETIC CONTAINER USING THE SAME

BACKGROUND OF THE INVENTION (1) Field of the Invention

The present invention relates to a sealing element, hermetic container and its sealing method for keeping contamination-averse items clean. More detailedly, the present invention relates to a sealing element, hermetic container and its sealing method to be used for accommodation and shipment of contamination-averse precision substrates such as semiconductor wafers, masking glass plates, liquid crystal cells, recording media, etc., and to be used for positioning precision substrates to processing machines which shape and process the substrates and for transportation and storage of them between processing machines.

(2) Description of the Prior Art

There are a variety of types of plastic storage containers for accommodating contamination-averse items. As one example, hermetic containers used for production of semiconductor parts can be mentioned. Large-diametric development(e.g., 300 mm or 400 mm or greater) of precision substrates used for fabrication of semiconductor parts, such as semiconductor wafers, masking glass substrates etc., has been discussed and demanded, aiming at reduction in cost by improving the production yield of semiconductor substrates, as price competition of semiconductor devices has become more severe. At the same time, semiconductor circuits have become more and more miniaturized. For example, the design rule (the minimum line width in processing) of DRAMs (dynamic random access memory) has been being shifted from 0.25 μm to 0.18 μm or less. Needless to say at the factories where semiconductor substrates are processed, there have been demands for high cleanness of the containers which are used to store semiconductor substrates when transported.

In order to meet such demands, a method, called 'SMIF' in abbreviation, has been proposed, which assures highly clean surroundings within limited, local spaces required for fabrication of semiconductor substrates and hermetically keeps a plurality of semiconductor substrates clean in a hermetic container so as to transport the hermetic container between several clean environmental spaces. To realize this method, development of hermetic containers which can be automatically conveyed without letting the precision substrates therein be contaminated and may allow itself direct access to the processing equipment is in progress.

As partly shown in FIGS. 1 and 2, a conventional hermetic container is comprised of a container body 1 having an opening on the front, a door element 11 detachably fitted to open and close the open front 9 of the container body 1 and a sealing element 20 interposed between the container body 1 and door element 11 for keeping the inside clean. This sealing element 20 may be a squeeze type made up of an O-ring having a circular section or a type shown in FIGS. 1 and 2.

The sealing element 20 of this type is formed of an endless molding of a material selected from various types of rubbers or elastomers. This sealing element 20, as shown in the same figures, is configured of a deformable endless portion 21 fitted into a fit-holding groove 16 formed on the outer peripheral side of door element 11, a recessed portion 25 of an approximately rectangular section, formed on the underside closer to the outer periphery of the endless portion 21 to create a clearance relative to door element 11, and a deformable rib 26 projected perpendicularly at the obverse surface on the outer peripheral side of endless portion 21 so as to come into contact with the inner periphery of the open front of container body 1.

When door element 11 is fitted to the open front 9 of container body 1 with a multiple number of precision substrates aligned and stored therein, this sealing element 20, especially part of endless portion 21 and rib 26 having a pin-like cross section, deform while recessed portion 25 adjusts the compressive force, to thereby totally seal the open front of container body 1.

Since, in the conventional hermetic container, sealing element 20 is formed of a mere molding of a rubber or elastomer, which cannot afford the necessary dimensional accuracy and the necessary deformability, it becomes markedly difficult, as the size of the opening of container body 1 becomes greater, to secure hermetic confinement by making sealing element 20 into uniform contact with the inner periphery of the open front. Particularly, the sealing element reveals marked deterioration of its sealing ability at the corners of open front 9 of container body 1, due to pressures in two different directions and its dimensional errors.

The above problem can be solved by making sealing element 20 undergo a greater amount of squeezing. However, upon standardization of the specifications of the device for opening and closing door element 11, the pressing force allowed to act on the opening and closing device of door element 11 is limited by an upper boundary, in order to protect the device and the hermetic container. Therefore, if the repulsive force of sealing element 20 exceeds the upper boundary, the repulsive force of sealing element 20 will apply a load greater than necessary on the opening and closing device of door element 11, causing a risk of interrupting the operation of door element 11. The sealing element 20 of the type shown in FIG. 1 presents its sealing function through rib 26, but this rib 26 can bend either inwards or outwards hence the direction of deformation is largely unknown, so that if the rib 26 flexes in reverse to the expected direction, the sealability may become uneven at that portion.

Further, since in local environments, the precision substrates should be loaded from the hermetic container for each processing step and be unloaded after each process, door element 11 of the hermetic container will be repeatedly opened and closed. Therefore, it frequently happens that sealing element 20 may displace from the proper position due to repeated opening and closing actions and be squeezed intensively between container body 1 and fit-holding groove 16 of door element 11 to be deformed greater than necessary. There is also another problem where expected sealability cannot be obtained or resin powder or particles may arise due to local rubbing of sealing element 20 when open front 9 of container body 1 is closed by door element 11, contaminating the precision substrates therein.

Moreover, when the hermetic container is washed in order to keep it clean, the conventional sealing element 20 has been washed while remaining fitted on container body 1 or door element 11. However, when a type of sealing element shown in FIG. 1 is used, not only is the sealing element not washed thoroughly because recessed portion 25 cannot be cleaned well, but also there is a risk that water droplets W might be left over. Therefore, a sealing element of this type is poor in cleansability and drainage, and takes a very long time to dry.

SUMMARY OF THE INVENTION

The present invention has been devised in view of what has been discussed above, and it is therefore an object of the present invention to provide a sealing element of a hermetic container, with which the inner periphery of the opening face of the container body can be substantially uniformly sealed and it is possible to prevent items from being contaminated without causing any interrupts of the automatic opening and closing actions of the door element and without degradation of sealability due to repeated opening and closing actions, and which can be cleansed thoroughly even when washing with the container body or door element, is excellent in cleansability and drainage and can reduce the time needed for drying. The present invention also provide a hermetic container with the sealing element and a sealing method thereof.

In order to achieve the above object, the present invention is configured as follows:

In accordance with the first aspect of the present invention, a sealing element which is interposed between the opening face of a fitted element and a fitting element and elastically deformable so as to prevent leakage from the interior and entrance from the exterior, comprises: an endless portion; a flexible protruding part projected approximately obliquely outwards from the periphery of the endless portion; and a fitting means having a notch or projection formed on at least one of the obverse and reverse sides of the endless portion.

In accordance with the second aspect of the present invention, the sealing element having the above first feature is characterized in that a rounded projection is formed at the distal end of the protruding part.

In accordance with the third aspect of the present invention, the sealing element having the above first feature is characterized in that the fitting means comprises a plurality of fitting ribs, and among the plurality of fitting ribs, the fitting rib located closest to the entrance side of a fit-holding portion formed on the opening face of the fitted element or on the fitting element side are higher than those located on the interior side of the fit-holding portion.

In accordance with the fourth aspect of the present invention, the sealing element having the above second feature is characterized in that the fitting means comprises a plurality of fitting ribs, and among the plurality of fitting ribs, the fitting rib located closest to the entrance side of a fit-holding portion formed on the opening face of the fitted element or on the fitting element side are higher than those located on the interior side of the fit-holding portion.

In accordance with the fifth aspect of the present invention, the sealing element having the above first feature is characterized in that the protruding part is set curved inwardly in the direction of squeezing so that the curved portion of the protruding part comes into contact with the contact surface of the fitted element or the contact surface of the fitting element.

In accordance with the sixth aspect of the present invention, the sealing element having the above second feature is characterized in that the protruding part is set curved inwardly in the direction of squeezing so that the curved portion of the protruding part comes into contact with the contact surface of the fitted element or the contact surface of the fitting element.

In accordance with the seventh aspect of the present invention, the sealing element having the above third feature is characterized in that the protruding part is set curved inwardly in the direction of squeezing so that the curved portion of the protruding part comes into contact with the contact surface of the fitted element or the contact surface of the fitting element.

In accordance with the eighth aspect of the present invention, the sealing element having the above fourth feature is characterized in that the protruding part is set curved inwardly in the direction of squeezing so that the curved portion of the protruding part comes into contact with the contact surface of the fitted element or the contact surface of the fitting element.

In accordance with the ninth aspect of the present invention, a hermetic container includes: a container body having an opening face; a door element to be detachably fitted to the opening face of the container body; and an elastically deformable sealing element interposed between the opening face and the door element, and is characterized in that a fit-holding portion is formed by notching either the inner periphery of the opening face of the container body or the outer periphery of the door element, and the sealing element comprises: an endless portion to be fitted into the fit-holding portion; a flexible protruding part projected from the endless portion, obliquely and outwardly with respect to the opening face of the container body, forming a substantially acute angle between itself and the contact surface of the door element or the contact surface of the opening face of the container body; and a fitting means having a notch or projection formed on at least one of the obverse and reverse sides of the endless portion and fitted in contact with the compartmentalized inner wall of the fit-holding portion.

In accordance with the tenth aspect of the present invention, the hermetic container having the above ninth feature is characterized in that the sealing element is formed using a fluororubber composition.

In accordance with the eleventh aspect of the present invention, a sealing method of a hermetic container, for sealing a hermetic container using a container body having an opening face, a door element to be detachably fitted to the opening face of the container body, a fit-holding portion formed by notching either the inner periphery of the opening face of the container body or the outer periphery of the door element and an elastically deformable sealing element fitted in the fit-holding portion and interposed between the container body and the door element, is characterized in that the sealing element is comprised of an endless portion to be fitted to the fit-holding portion, flexible protruding part extended from the endless portion and a fitting means having a notch or projection formed on at least one of the obverse and reverse sides of the endless portion and fitted in contact with the compartmentalized inner wall of the fit-holding portion, the protruding part of the sealing element is extended approximately obliquely and outwardly with respect to the opening face of the container body so as to form a substantially acute angle between itself and the contact surface of the door element or the contact surface of the opening face of the container body, and the protruding part of the sealing element is curved outwards with respect to the opening face of the container body to establish sealing when the door element is closed.

Next, the effects of the present invention will be described.

First, according to the present invention, when the opening face of a fitted element such as a pipe, cassette, box, mechanical part, transport container, receptacle, etc., is closed by a fitting element such as a mechanical part, door element, etc., a sealing element is fitted to a fit-holding portion such as a fit-holding groove or the like formed on the fitted element or the fitting element in such a manner that a protruding part of the sealing element is directed outwards from the outer periphery of the endless portion. Then, the fitting element is fitted to the opening face of the fitted element while the protruding part of the sealing element is set obliquely outwards with respect to the opening face of the fitted element, forming a substantial acute angle between the protruding part or its extension and the contact surface of the opening face of the fitted element or the contact surface of the fitting element. In this arrangement, upon fitting, the opening face of the fitted element can be properly sealed by the fitting element by making the protruding part of the sealing element deform outwards with respect to the opening face of the fitted element.

According to another aspect of the present invention, when more than one fitting ribs are formed on the obverse surface of the endless portion at inner and outer peripheral sites, it is possible to disperse the retaining force. Accordingly, the retaining force for each rib can be set to be smaller compared to the configuration where only a single rib is provided. Therefore, the margin of the rib to be squeezed can be reduced so as to allow easy attachment. Further, the sealing element is easy to fit into fit-holding portion, and yet the sealability is improved.

Further, according to the present invention, when the opening face of a container body having items stored therein is closed by a door element, a sealing element is fitted to the fit-holding portion of the container body or door element in such a manner that the protruding part of the sealing element is directed peripherally outwards. Then, the door element is fitted to the opening face of the container body while the protruding part of the sealing element is set obliquely outwards with respect to the opening face of the container body, forming a substantial acute angle between the protruding part or its extension and the contact surface of the opening face of the container body or the contact surface of the door element. In this arrangement, upon fitting, the opening face of the container body can be hermetically sealed by the door element by making the protruding part of the sealing element deform outwards with respect to the opening face of the container body.

Finally, according to the present invention, since the sealing element is formed of a fluororubber composition, the sealing element can be formed with high dimensional precision and also can be deformed relatively easily. Further, it is possible for fluororubber composition to generally provide excellent heat resistance, oil resistance, chemical resistance for the sealing element. Since the amount of vaporization of organic components is quite low, this makes it possible to avoid the stored items being contaminated.

BRIEF DESCRIPTION OF THE DRAWINGS

FIG. 3A is a perspective view of an underside portion of the container of FIG. 3;

DESCRIPTION OF THE PREFERRED EMBODIMENTS

Figure 1:
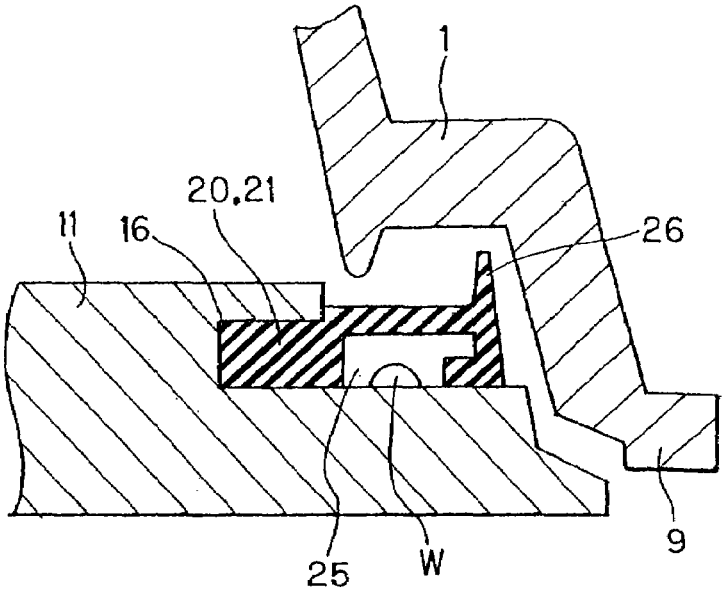
FIG. 1 PRIOR ART
FIG. 1 is a partial sectional view for illustrating a conventional hermetic container and its sealing method.
Figure 2:
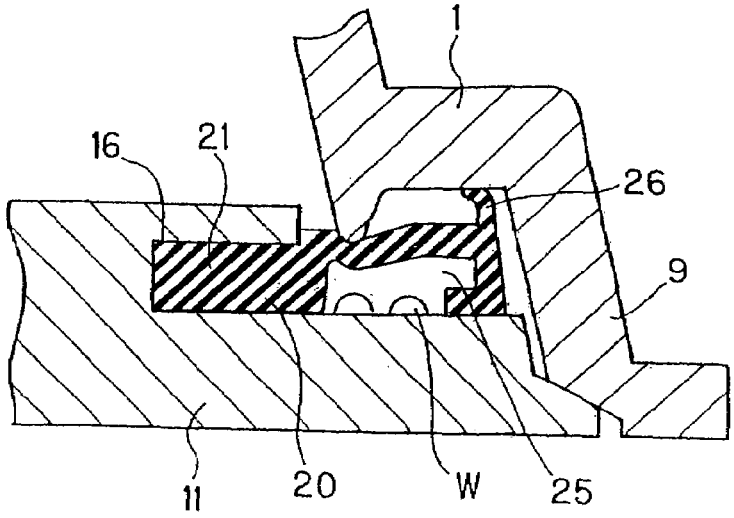
FIG. 2 PRIOR ART
FIG. 2 is a partial sectional view for illustrating the sealing element shown in FIG. 1 being deformed.

Herein, the protruding part extending approximately obliquely in the description in the present invention may include that extending exactly obliquely and that extending approximately obliquely, which means that a curved portion may be partially included. The rounded projection described herein may include a projection having an exact circular section and a projection having an approximately circular section. The fitting rib may be formed to have a triangular, semicircular, semi-elliptic, semi-oval, trapezoidal section or other sectional shapes. One or multiple number of fitting ribs may be provided as appropriate. The substantially acute angle described herein may include a strictly defined acute angle and a shape approximating an acute angle. The opening face of the container body may be arranged at the front, on the top or on any side face. The door element is formed in an approximate rectangular, approximate circular, approximate oval shape or any other shape, conforming to the shape of the opening face. Further, main contents of the hermetic container are semiconductor wafers, masking glass substrates, liquid crystal cells, recording media and the like, but should not be limited to these. Various kinds of items such as, for example, domestic use items, mechanical parts, electric and electronic parts, anti-environmental items and the like may be stored either singly or plurally.

Now the preferred embodiments of the present invention will be described with reference to the accompanying drawings. The hermetic container in the first embodiment is constructed, as shown in FIGS. 3 through 8, such that an approximately rectangular door 11 is detachably fitted to an open front 9 of a front-open box type container body 1 with an elastically deformable, endless sealing element 20 interposed between so as to establish hermetic confinement. The door 11 is also referred to herein as a fitting element, while the container body 1 is referred to as a fitted element.

Figure 3:
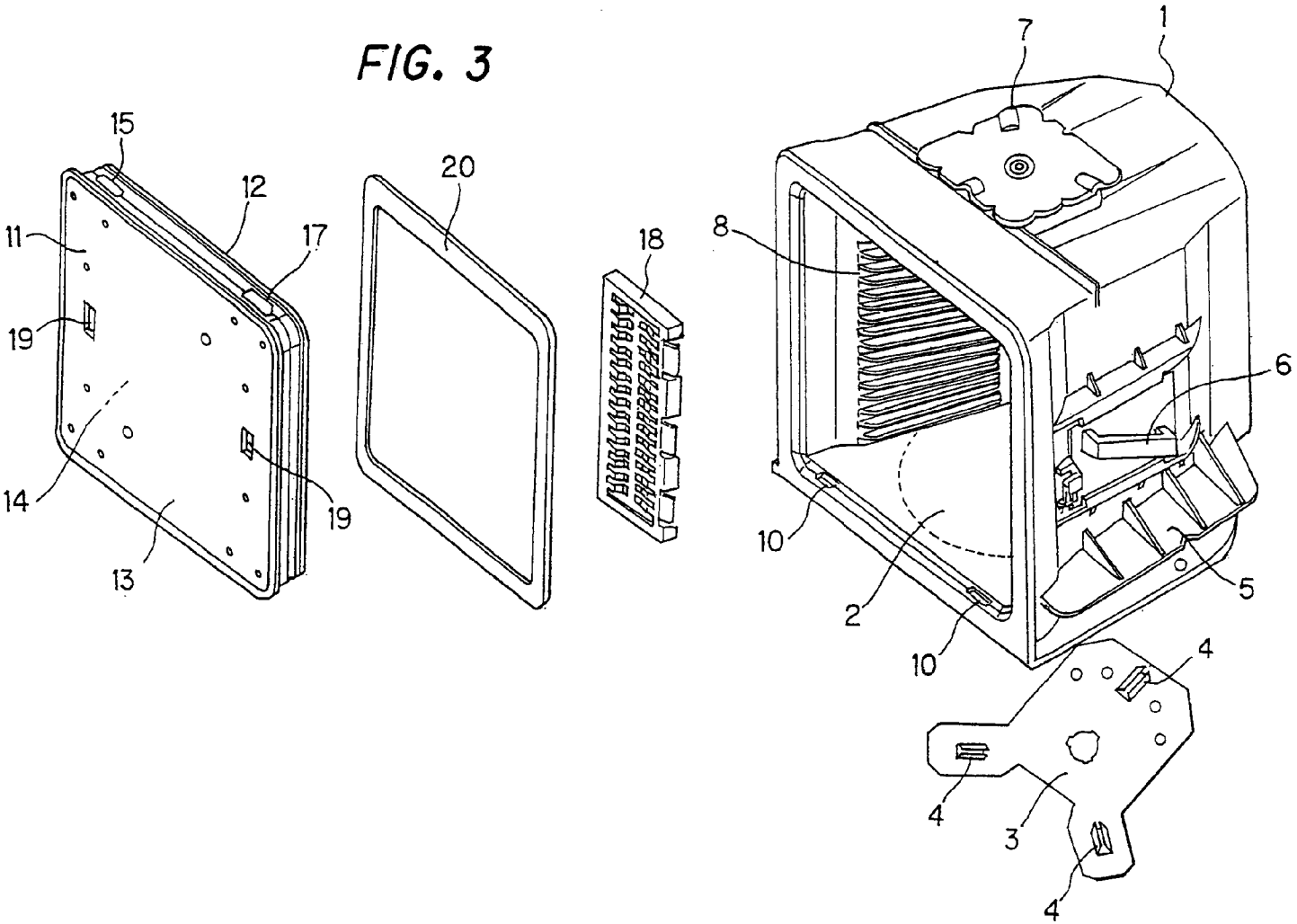
FIG. 3 is an exploded perspective overall view showing the embodiment of a hermetic container and its sealing method according to the present invention.

As shown in FIG. 3, container body 1 is formed of a transparent or opaque, approximately cubic molding made up of a synthetic resin such as polycarbonate, polypropyrene or the like, so as to accommodate a multiple number of circular precision substrates 2 arranged vertically with a predetermined pitch. This container body 1 has on its underside V-grooves which are projectively formed at both sides on the front side and at the center on the rear side and function as positioning means relative to unillustrated precision substrate processing equipment. A plate-like bottom plate 3 is attached to these V-grooves and detachably supported thereby. This bottom plate is molded as an approximate Y-shape when viewed from top, made up of two forked arms arranged at left and right on the front side and one arm extending to the center on the rear side. Each arm has a guidance portion 4 formed so as to mate the corresponding V-groove.

Figure 7:
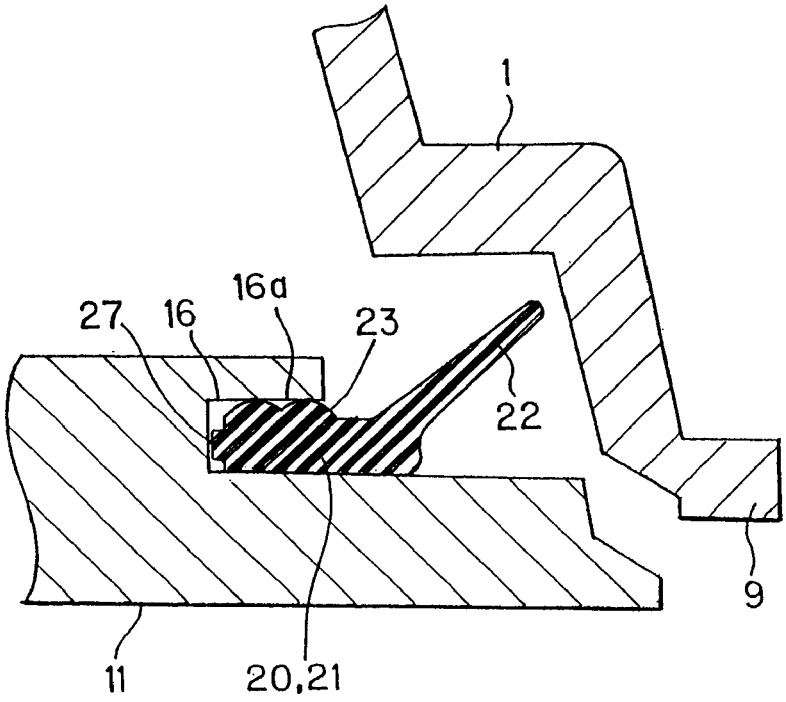
FIG. 7 is a partial sectional illustration showing a state where a door element with a sealing element fitted thereon is fitted to a container body of the embodiment of a hermetic container and its sealing method according to the present invention.
Figure 8:
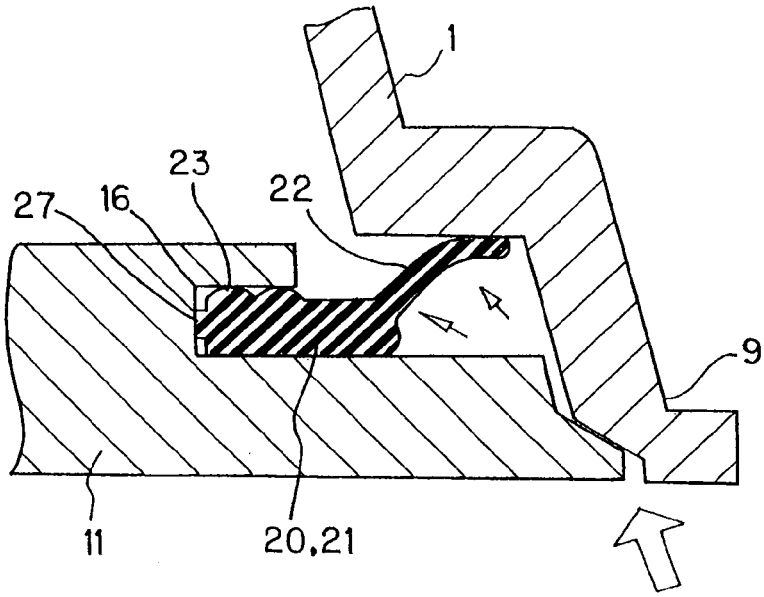
FIG. 8 is a partial sectional illustration showing a state where the protruding part of the sealing element shown in FIG. 7 is being bent.

As shown in the same drawing, separate parts such as side rails 5 and manual handles 6 can be selectively attached in a detachable manner to left and right side faces of container body 1. Further, a robotic flange 7, which will be held by an unillustrated conveyer robot, may selectively mounted in a detachable manner at the center on the top of container body 1. Formed integrally or detachably on both inner sides, left and right, of container body 1 are a pair of rack-like supporting portions 8, between which a multiple number of precision substrates 2 are put horizontally in alignment with each other with a predetermined pitch. As shown in FIGS. 7 and 8, open front 9 of container body 1 is formed with a step, gradually spreading outward toward the exterior of the container, so that door element 11 can be guided smoothly and fitted quickly when door element 11 is closed. Dented in the inner periphery of open front 9 of container body 1 are engagement holes 10 at the right and left, on both upper and lower sides, as shown in FIG. 3.

Door element 11 is comprised of inner and outer plates 12 and 13 fitted to and opposing each other with a clearance therebetween, as shown in FIG. 3. A latch mechanism 14 is built in between these inner plate 12 and outer plate 13, so that when door element 11 is fitted to container body 1, this latch mechanism 14 causes retractable engagement claws 15 to project out into respective engagement holes 10 to establish an air-tight state inside the hermetic container. As shown in FIGS. 7 and 8, an endless, indented, fit-holding groove 16 is notched on the outer peripheral side of door element 11 while passage holes 17 for engagement claws 15 are formed at the right and left, on both top and bottom sides of the outer periphery, as shown in FIG. 3. A rack-like retainer 18 is detachably mounted on inner plate 12 so as to resiliently support a multiple number of precision substrates 2 by their front rim. A pair of manipulative keyholes 19 for latch mechanism 14 are formed at both left and right in outer plate 13.

Sealing element 20 is formed of a molding having a hardness of about A60/S to A90/S (measured based on JIS K 6253) using a thermoplastic elastomer, fluororubber, EPDM, NBR or the like. As the material of this sealing element 20, fluororubber is the most preferable because it generates a lesser amount of organic gas components during heating and has the least adverse effect on precision substrates 2. Sealing element 20, as shown in FIGS. 4 to 6, is comprised of an endless portion 21 having an approximately rectangular section to be fitted into fit-holding groove 16, a protruding part 22 which protrudes outwards from the entire peripheral corner on the outer side of this elastically deformable endless portion 21 or protrudes obliquely, outwards and toward the open front of container body 1, forming a substantial acute angle between itself and the contact face of open front 9 of container body 1, and a pair of elastically deformable fitting ribs 23 which are projectively formed, side by side, on the obverse surface close to the inner periphery of endless portion 21 so as to come into pressure contact with a compartmentalized inner wall 16*a* of fit-holding groove 16.

Figure 4:
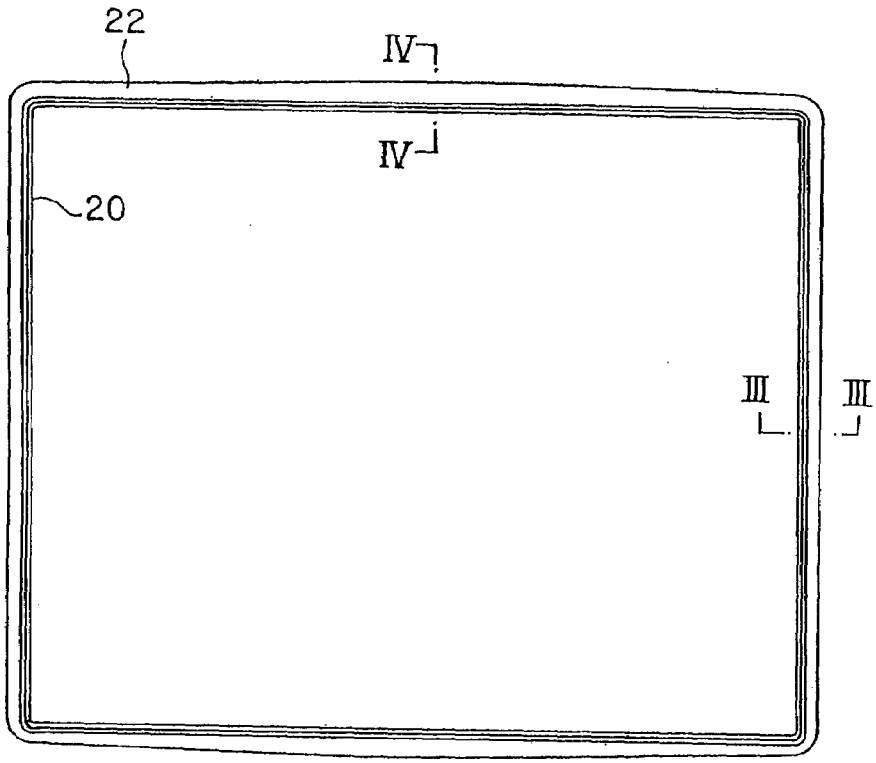
FIG. 4 is a front view showing a sealing element in the embodiment of the sealing element, hermetic container and its sealing method according to the present invention.

As shown in FIG. 4, endless portion 21 is basically formed in a frame shape with its four corners rounded. Protruding part 22, as shown in FIGS. 5 and 6, is formed in a tapered configuration having an approximately triangular section, so that it becomes gradually narrower from the proximal part toward the distal end. Specifically, the length of protruding part is set to be 0.5 to 3 times of the width of endless portion 21, more preferably 0.7 to 2 times. In order for this protruding part 22 to produce a beneficial repulsive force, the proximal part is formed to be 0.4 to 2 mm thick and the thickness of the distal part is set to be 50 to 80% of that of the proximal part. Protruding part 22 is extended obliquely. This angle of inclination of protruding part 22 is set so as to fall within the range of 10° to 70°, preferably 25° to 45°,with respect to the line from the outer periphery of endless portion 21 to the open front 9 of container body 1.

Each fitting rib 23, as shown in the same drawing, is formed to have a semicircular section and so as to be higher by about 1 to 25% than the width of fit-holding groove 16. When endless portion 21 is fitted into fit-holding groove 16, 1 to 25% of the height is compressed so as to fill the interior space of fit-holding groove 16, which assures firm attachment of the sealing element.

Figure 5:
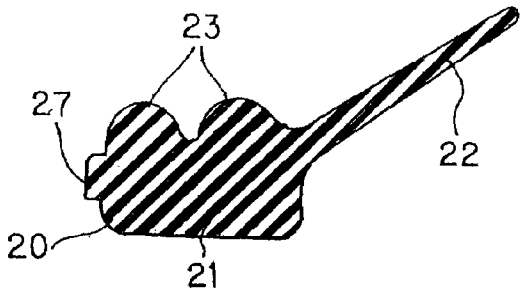
FIG. 5 is a sectional view cut along a plane III-III in FIG. 4.
Figure 6:
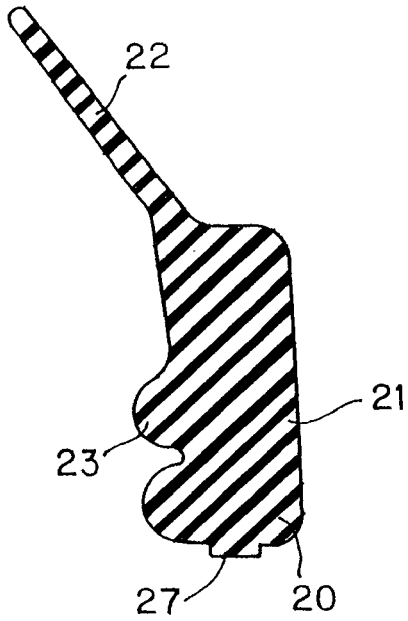
FIG. 6 is a sectional view cut along a plane IV-IV in FIG. 4.

In connection with this, it is preferred that a vertical wall or a projection 27 having a vertical wall for positioning should be formed on the inner side wall of sealing element 20, as shown in FIG. 5. This projection 27 makes it possible to position sealing element 20 exactly inside fit-holding groove 16. By the holding and positioning arrangements, sealing element 20 is attached exactly inside fit-holding groove 16 while its displacement can be suppressed, whereby it is possible to seal fit-holding groove 16 in a preferable manner.

In the above configuration, when the open front of container body 1 having a plurality of precision substrates 2 held in alignment therein is closed with door element 11, sealing element 20 has been fitted beforehand in fit-holding groove 16 of door element 11 so that protruding part 22 of sealing element 20 is directed outwards from the periphery. After the arrangement has been got ready in the above way, door element 11 is fitted to open front 9 of container body 1 by the precision substrate processing machine in such a manner that sealing element 20 is held between container body 1 and door element 11 with its protruding part 22 directed obliquely and outwards with respect to the open front of container body 1, forming a substantially acute angle between protruding part 22 or its extension and the contact surface of open front 9 of container body 1 (see FIG. 7). Then, as latch mechanism 14 is locked by the precision substrate processing machine, protruding part 22 of sealing element 20 becomes flexed outwards with respect to the open front of container body 1 (see FIG. 8), thus making it possible for door element 11 to seal open front 9 of container body 1, airtightly.

In the above way, protruding part 22 of sealing element 20 is bent outwards with respect to the open front of container body 1, instead of being compressed in the direction of attachment of door element 11 (in the vertical direction in FIG. 8). Therefore, it is possible to markedly reduce the load at the fitting of the door element. This arrangement also contributes to smooth fitting of container body 1 and door element 11 hence reduction of troubles when the door element is opened and closed.

According to the above configuration, since sealing element 20 can be molded in a simple shape using fluororubber, it is greatly expected that the sealing element can be formed with high precision and high flexibility. Therefore, this configuration makes it quite simple to bring sealing element 20 into uniform contact with the inner periphery of the open front of container body 1 and establish necessary sealing. In the present invention, since protruding part 22 as a part of sealing element 20 is formed in a tapered shape having a triangular section, the sealing element can be deformed by a small pressure and also can produce moderate repulsive force because of its inclination outwards. Therefore, no marked degradation of sealability will occur even at the corners of open front 9 of container body 1, for example.

Further, since it is not necessary for sealing element 20 to be greatly squeezed, there is no risk of an excessive load being acted on the opening and closing device of door element 11 by the repulsive force of sealing element 20 hence it is possible to effectively eliminate any interruption when door element 11 is operated. Since protruding part 22 is extended obliquely outwards, protruding part 22 will not deform either inward or outward. Therefore, it is possible to prevent protruding part 22 from flexing in the reverse direction and hence prevent sealing unevenness which would occur at that portion.

It is also possible to provide beneficial sealing if a pressure difference occurs between the interior and exterior of the hermetic container. For example, suppose that internal pressure of the hermetic container becomes higher than the external pressure due to change in temperature or any other reason and internal air is displaced to the outside. In this case, the internal pressure acts on protruding part 22 in such a direction to lessen the flexure of the protruding part, so that air is easily released to the outside hence the pressure difference can be neutralized within a relatively short period. In this case, there is no concern of the interior of container body 1 being contaminated because inner air flows out from the container body 1. In contrast, when a higher pressure externally acts on the hermetic container and causes air, contaminant, etc., to tend to enter container body 1, the protruding part 22 is pressed further in the direction of the flexure and enhances the sealability, making outside air difficult to enter the inside. Accordingly, it is possible to reliably prevent external air (see the arrow in FIG. 8) from entering the container and hence contaminating precision substrates 2.

Moreover, since the sealing element is positioned by a pair of fitting ribs 23 being squeezed against compartmentalized inner wall 16*a* of fit-holding groove 16 so as to make it hard to slip out, sealing element 20 will not displace from the proper position even when opening and closing actions of door element 11 are repeated frequently. Therefore, there is no fear of contamination of precision substrates 2 by excessive deformation of sealing element 20 due to being squeezed between container body land fit-holding groove 20 of door element 11, by loss of sealability, or by generation of resin power or particles due to local rubbing of sealing element 20. Further, when in order to keep the hermetic container clean sealing element 20 is washed while remaining fitted on container body 1 or door element 11, it is possible to wash the sealing element thoroughly without leaving any water droplets W because there is no dented portion such as recessed portion 25 in the exposed areas of sealing element 20. Accordingly, it is possible to improve the cleansability and drainage, hence the time for drying can be markedly reduced.

Figure 9:
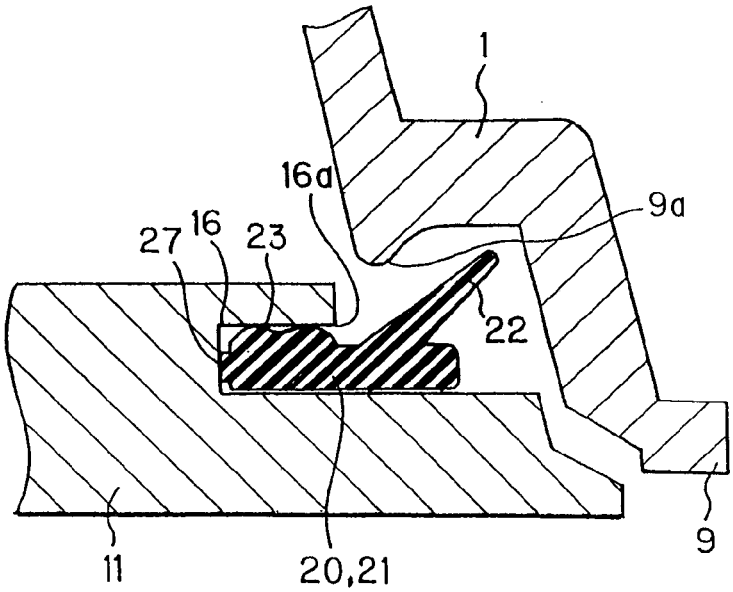
FIG. 9 is a partial sectional illustration showing the second embodiment of a hermetic container and its sealing method according to the present invention.

Next, FIG. 9 shows the second embodiment of the present invention. In this case, the contact portion, designated at 9*a*, of the open front 9 of container body 1, with sealing element 20, is formed so as to bulge toward the opening while a flexible protruding part 22 is projected obliquely and outwards from the obverse surface close to the periphery of endless portion 21. Contact portion 9*a* of container body 1 is formed partly curved near the stepped portion of open front 9 so as to mate the curved shape of protruding part 22 when it is bent. This contact portion approximately opposes the proximal portion of protruding part 22 when door element 11 is closed. Protruding part 22 may be formed so as to protrude linearly or slightly curved. Other parts are the same as the above embodiment so the description is omitted.

With this embodiment, the same operational effects as that of the above embodiment can be expected. Further, since contact portion 9*a* of container body 1 fits the curved shape of protruding part 22 as being deformed and guides it, it is possible to guide the protruding part 22 to deform in the correct direction even when an external pressure acts on the sealing element 20. As a result, it is apparent that this configuration is able to provide further improved sealability and protection against contamination of precision substrates 2.

Figure 10:
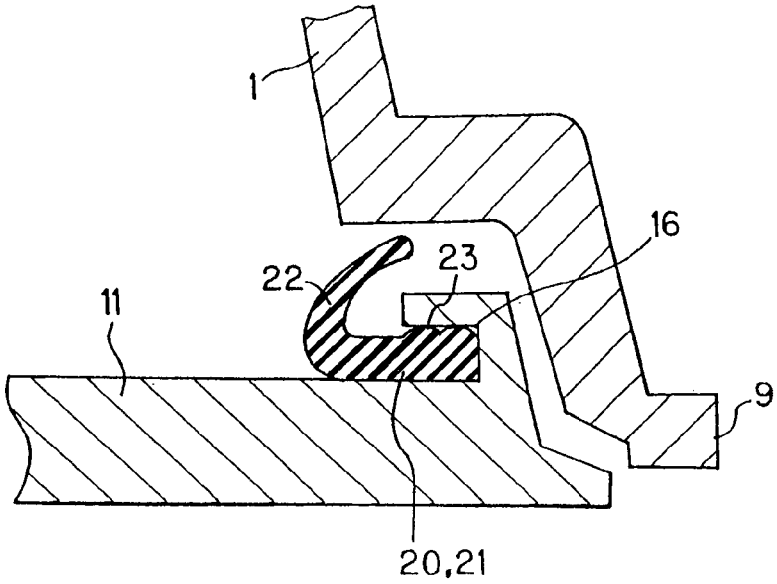
FIG. 10 is a partial sectional illustration showing the third embodiment of a hermetic container and its sealing method according to the present invention.

Next, FIG. 10 shows the third embodiment of the present invention. In this case, a flexible protruding part 22 is projected from the inner peripheral side of endless portion 21 and curved so as to have a fishhook-shaped section and folded to be extended obliquely outward while a pair of fitting ribs 23 are formed side by side on the obverse surface of endless portion 21 close to its outer periphery. Other parts are the same as the above embodiments so the description is omitted.

Also with this embodiment, the same operational effects as that of the above embodiments can be expected. Further, this configuration is markedly effective if the above first and second configurations cannot be used.

Figure 11:
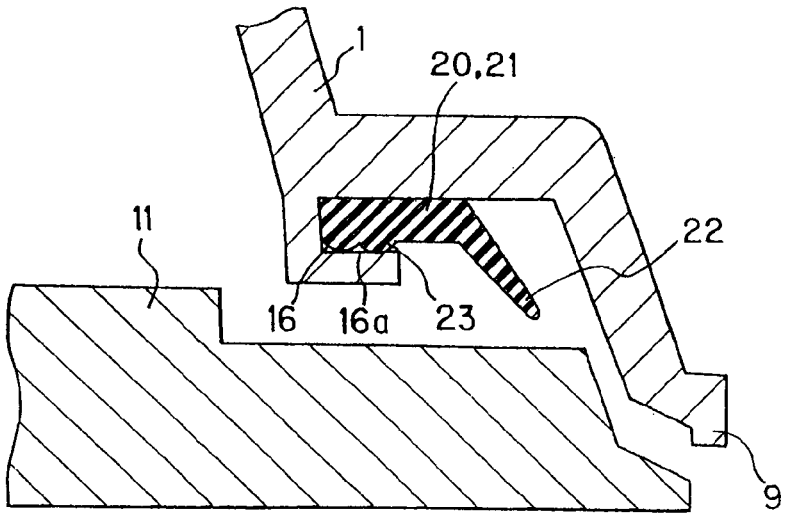
FIG. 11 is a partial sectional illustration showing the fourth embodiment of a hermetic container and its sealing method according to the present invention.

Next, FIG. 11 shows the fourth embodiment of the present invention. In this case, a fit-holding groove 16 is notched on the inner periphery of the open front of container body 1 by forming a compartment wall having an approximately L-shaped section. A sealing element 20 is fitted into the thus recessed portion, i.e., fit-holding groove 16. Other parts are the same as the above embodiments so the description is omitted.

Also with this embodiment, the same operational effects as that of the above embodiments can be expected. Further, this configuration is markedly effective if the above first, second and third configurations cannot be used.

Next, FIGS. 12 through 15 show the fifth embodiment of the present invention. In this case, a flexible protruding part 22 is projected obliquely with a slight curvature from the entire peripheral corner on the outer side of the endless portion 21. This protruding part 22 is integrally formed at its distal end with a rounded projection 28 while a pair of fitting ribs 23*a* and 23*b* having substantially triangular sections having different inclinations from each other are projectively formed, side by side on the obverse surface close to the inner periphery of endless portion 21.

Figure 12:
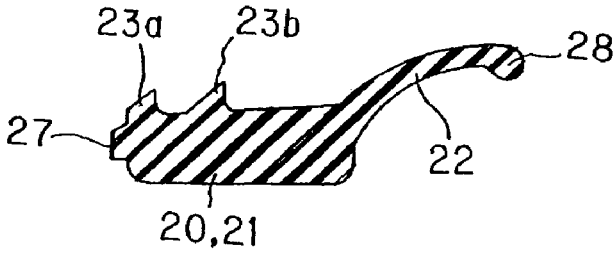
FIG. 12 is a sectional illustration showing a sealing element of the fifth embodiment of a hermetic container and its sealing method according to the present invention.
Figure 13:
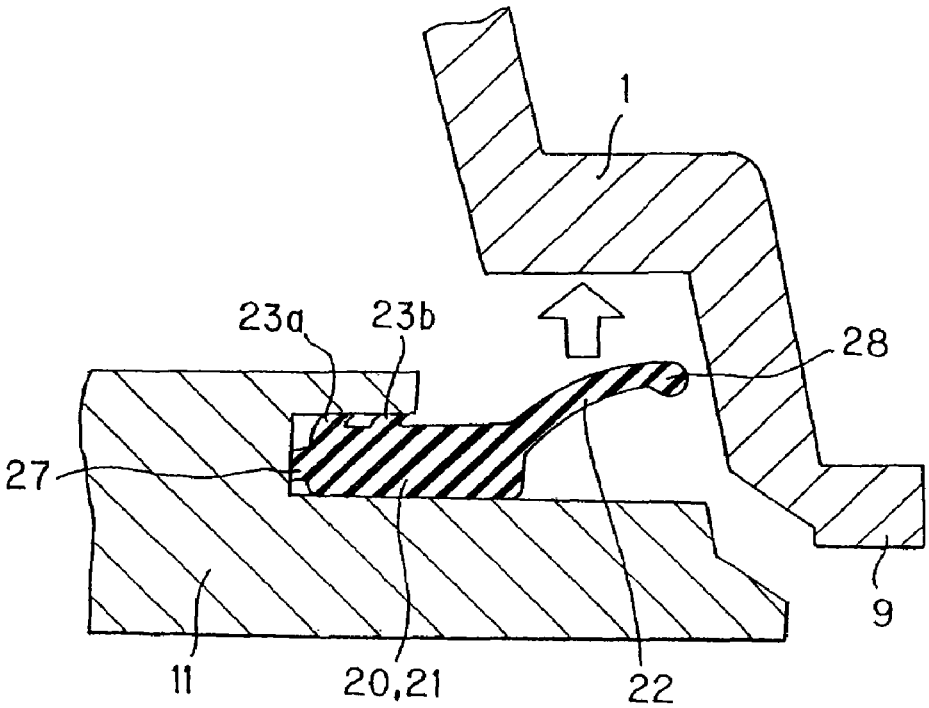
FIG. 13 is a sectional illustration showing a state where the sealing element shown in FIG. 12 is used to fit the door element to the container body.
Figure 15:
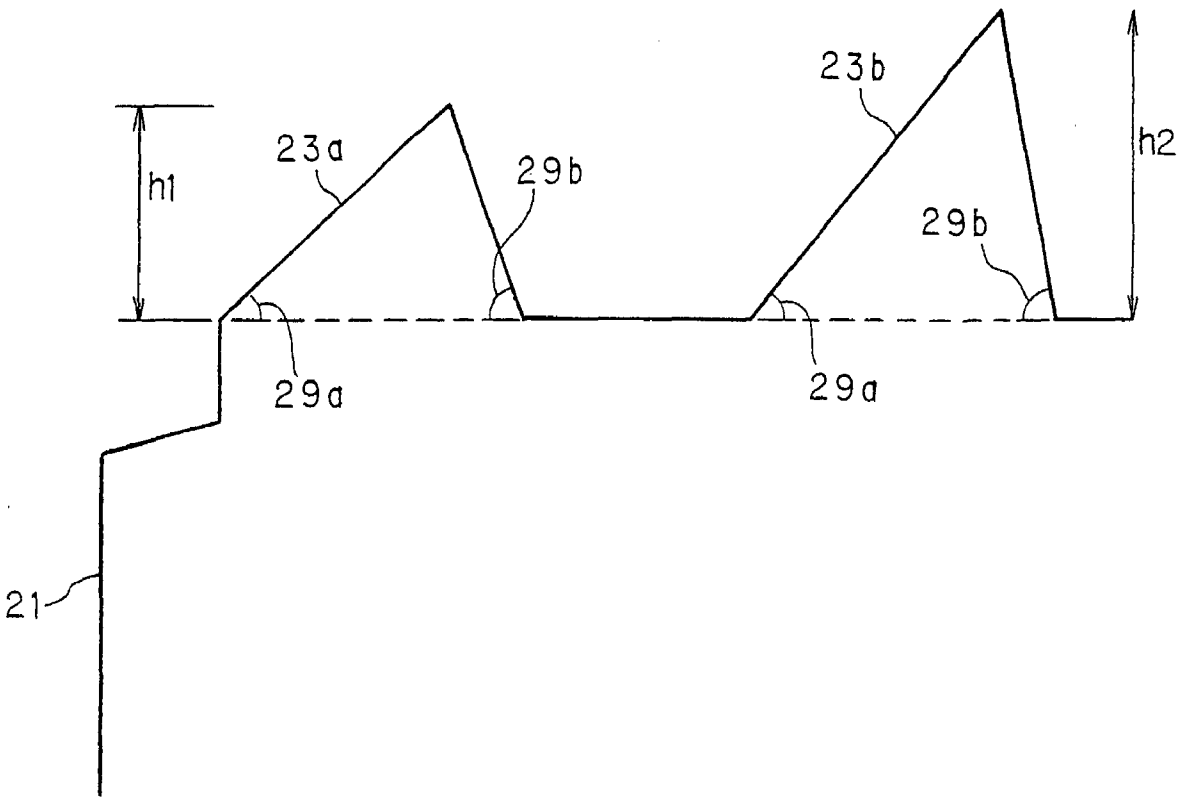
FIG. 15 is a partially enlarged illustration showing the sealing element of FIG. 12.

Protruding part 22 is formed so as to be curved toward the open front of container body 1 with a radius of curvature R of 3 to 10 mm. Rounded projection 28 is preferably formed with a radius of curvature R ranging from 0.3 to 0.8 mm. Fitting ribs 23*a* and 23*b* are formed to have an inclined surface from the obverse surface toward the interior side, as shown in FIGS. 12 and 15. The fitting rib 23*a* positioned on the obverse surface of endless portion 21 at the inner side is projectively formed at a smaller height (e.g., 0.8 mm high) while the fitting rib 23*b* positioned on the obverse surface of endless portion 21 at the outer side is projectively formed to be higher. Other parts are the same as the above embodiments so the description is omitted.

Also with this embodiment, the same operational effects as that of the above embodiments can be expected. Further, rounded portion 28 is formed swellingly at the distal end of protruding part 22, instead of forming a linear, knife-edged portion, which is difficult to mold, the molding process can be markedly simplified. Since the distal end of protruding part 22 is formed with rounded projection 28, it is possible to reduce generation of particles from the distal end of sealing element 20 which repeatedly contact with container body 1.

Figure 14:
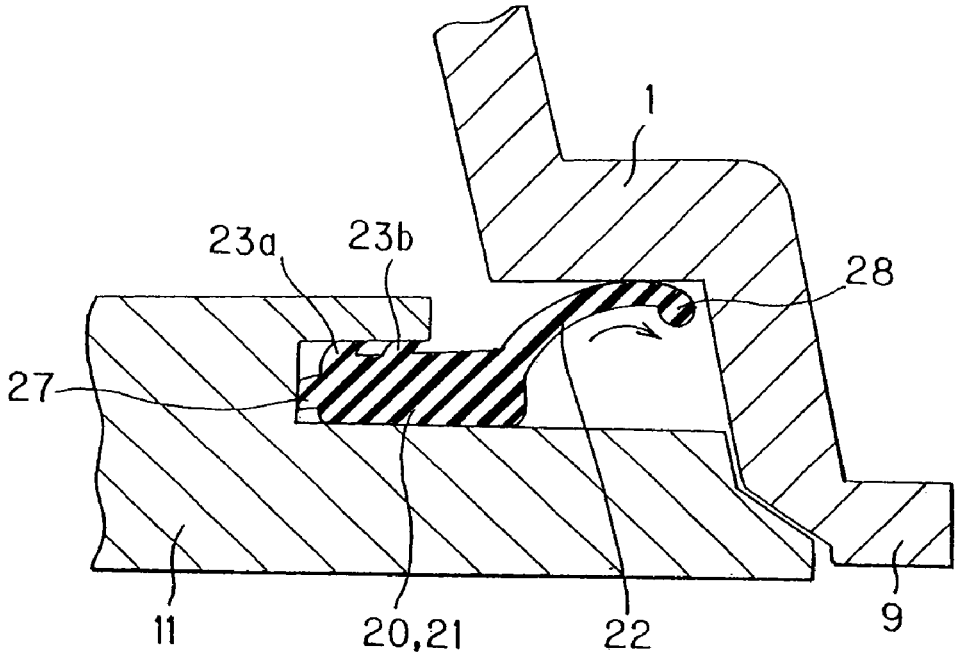
FIG. 14 is a partial sectional illustration showing a state where the protruding part of the sealing element shown in FIG. 13 is being deformed.

Further, as shown in FIG. 14, since protruding part 22 is curved inwardly with respect to the compressed direction so that it will deform along this curved shape (see the arrow in the drawing), it is possible to markedly reduce the frictional resistance with container body 1. This makes it possible to reduce the resistance when the door element is opened and closed, whereby a reliable sealing can be provided with a small compressing force, leading to markedly effective suppression of troubles with opening and closing of door element 11. Further, since fitting rib 23*a* positioned on the inner side or the interior side at assembly is formed to be lower (h1) and fitting rib 23*b* positioned on the outer side, or the near to the opening at assembly is formed to be higher (h2), as shown in FIG. 15, sealing element 20 can be smoothly fitted into fit-holding groove 16 when it is assembled.

Still more, as shown in FIG. 15, fitting ribs 23*a* and 23*b* are projected in approximately triangular shapes with their angles 29*a* and 29*b* have the relationship: 29*a*<29*b*. Therefore, once the sealing element has been fitted to door element 11, each corner apex is inclined toward the opening side of fitting groove 16 and abuts against the wall. As a result, these corner apexes function like barbs when the protruding part is pulled toward the opening side, thus making it difficult for the sealing element to come off. Thus, this configuration provides a structure which prevents the sealing element from displacing while being used.

Though latch mechanism 14 is incorporated inside door element 11 in the above embodiment, this latch mechanism 14 can be substituted by other engaging mechanisms such as clamps, holding devices or the like. Further, in the above embodiments, frame-shaped sealing element 20 has been illustrated, the present invention should not limited to this. For example, sealing element 20 maybe formed of other shapes such as circular, oval and polygonal shapes with a vacant center. Endless portion 21 may have an approximately elliptic cross-section or other shape, instead of an approximately rectangular cross-section. Further, one or more projections may be formed on the compartmentalized wall 16*a* inside fit-holding groove 16 while one or more notches as the engaging means may be formed on the obverse surface of endless portion 21 at the inner and/or outer sides so that these projections and notches mate each other.

Figure 16:
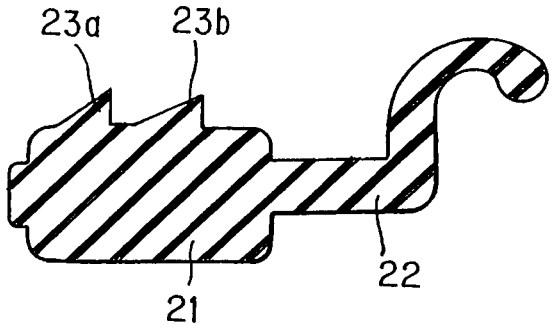
FIG. 16 is a sectional illustration showing a sealing element in the sixth embodiment of a hermetic container and its sealing method according to the present invention.

FIG. 16 shows the sixth embodiment of the present invention. In this case, a protruding part 22 is projected horizontally from the entire peripheral side of endless portion 21 and extended upwards, forming a curved portion. A rounded projection is formed swellingly at the distal end of the protruding part. A pair of fitting ribs 23*a* and 23*b* having approximate triangular cross-sections having different inclinations are projectively formed side by side on the obverse surface at the inner side of endless portion 21.

The horizontal portion can be formed at any position on the outer periphery of the endless portion. The horizontal portion of the protruding part is 1 to 8 mm long, preferably 1 to 5 mm while the curved portion is formed sideways above the end so as to have a radius of curvature R of 1 to 4 mm, preferably 1.5 to 3 mm. Further, a rounded projection is swellingly formed at the distal end of the curved portion with its radius of curvature R of 0.3 to 0.8 mm.

Also in this case, the distal end of the protruding part is located at a position obliquely extended from the outer peripheral side of the endless portion, so that the same effects as that of the fifth embodiment can be expected.

Figure 17:
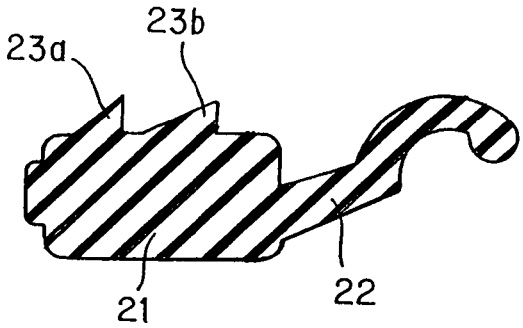
FIG. 17 is a sectional illustration showing a sealing element in the seventh embodiment of a hermetic container and its sealing method according to the present invention.

FIG. 17 shows the seventh embodiment of the present invention. In this case, a protruding part 22 is extended obliquely from the entire peripheral side of endless portion 21 to one end from which a curved portion is formed. A rounded projection is formed swellingly at the distal end of the protruding part. A pair of fitting ribs 23*a* and 23*b* having approximate triangular cross-sections having different inclinations are projectively formed side by side on the obverse surface at the inner side of endless portion 21. In this case, the protruding part is extended obliquely upwards from the endless portion with an angle of inclination of 20° to 60°, preferably 20° to 45°, and continuously formed with the curved portion with a rounded projection at the distal end, in a similar manner to that of the sixth embodiment.

Further, the projected portion extended obliquely may have a substantially uniform thickness of 0.6 to 1.5 mm at its proximal side. It is further preferred that the projected portion is formed so as to become gradually narrower toward the end. Also in this case, the distal end of the protruding part is located at a position obliquely extended from the outer peripheral side of the endless portion, so that the same effects as that of the fifth embodiment can be expected.

Now, examples of hermetic containers of the present invention will be described together with comparative examples.

1. Hermetic Container Sealability Confirmatory Test

EXAMPLE

A sealing element 20 formed in the shape as shown in FIGS. 4 to 6 was formed using fluororubber. This sealing element 20 was fitted to a hermetic container for in-process transport, capable of accommodating 25 sheets of 300 mm precision substrates (silicon wafers) 2, and a sealability confirmatory test was carried out.

Figure 18:
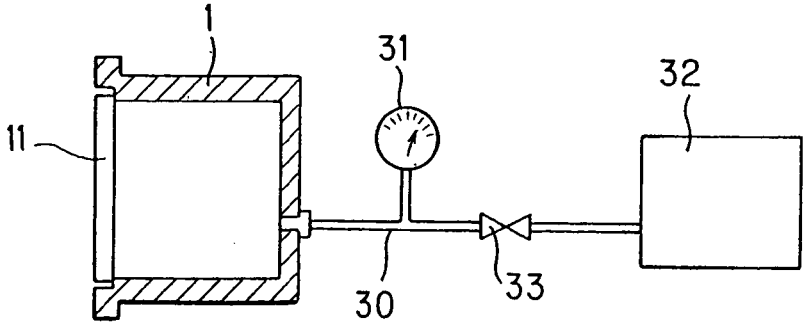
FIG. 18 is a sectional illustration showing one embodiment of a hermetic container and its sealing method according to the present invention.

The confirmatory test was implemented in the manner as shown in FIG. 18. Specifically, a flexible hose, namely a pipe 30, was connected to a container body 1 having a passage hole drilled at the lower site on the backside thereof and the joint between the passage hole and pipe 30 was sealed with a sealant. Open front 9 of container body 1 was fitted and closed with door element 11 with sealing element 20 fitted thereon. A pressure gauge 31 was set in pipe 30 while a pressure device 32 for pressurizing the interior of the hermetic container and a pump for reducing the pressure inside the hermetic container were joined via a gate valve to the distal end of pipe 30. Then, changes in pressure were measured for the case where the interior of the hermetic container was pressurized (plus $2\times10^4$ Pa) and then gate valve 33 closed and for the case where the interior of the hermetic container was evacuated (minus $2\times10^4$ Pa) and then gate valve 33 closed, were measured by pressure gauge 31 to check the sealability. The result is shown in Table 1.

COMPARATIVE EXAMPLE

A sealing element 20 formed in the shape shown in FIG. 1 was formed using fluororubber, and the same confirmatory test as the example was implemented. The result is shown in Table 1.

TABLE 1

| | $-2 \times 10^4$ Pa (when evacuated) | plus $2 \times 10^4$ Pa (when pressurized) |
|---|---|---|
| Example | $-9 \times 10^3$ Pa after 10 min. | 0 Pa after 20 sec. |
| Comparative Example | $-2 \times 10^3$ Pa after 10 min. | 0 Pa instantly |

2. Measurement of the Repulsive Force of Sealing Elements

EXAMPLE

A 3 cm sample of linear section was cut from the sealing element 20 used in the sealability confirmatory test and the amount of squeezing and its repulsive force when this sample was pressed were measured by a precision universal tester (a trade name: Autograph, a product of SHIMADZU CORPORATION). The result is shown in Table 2.

COMPARATIVE EXAMPLE

Similarly to the example, a sample of 3 cm linear section was cut from the sealing element 20 used in the sealability confirmatory test and the amount of squeezing and its repulsive force when this sample was pressed were measured by the precision universal tester. The result is shown in Table 2.

TABLE 2

| | Repulsive Force (N/cm) | | |
|---|---|---|---|
| Amount of Squeezing (mm) | 0.5 | 1.0 | 1.5 |
| Example | 0.12 | 0.19 | 0.19 |
| Comparative Example | 0.94 | 0.94 | 1.46 |

As has been described, according to the present invention, it is possible to substantially uniformly seal the inner periphery of the opening face of the container body. Further, it is possible to prevent items from being contaminated without causing any interrupts during the operation of the door element and without any loss of sealability due to repeated opening and closing actions. Moreover, even when being washed with the container body or door element, the sealing element can be washed well so as to improve the cleansability and drainage and the time needed for drying can be reduced.

What is claimed is:

1. A hermetic container comprising:

a sealing element which is interposed between an opening face and a door element of a storage container for precision substrates wherein the storage container comprises:

a container main body having the opening and supporting portions between which the precision substrates are put in alignment with each other;

wherein the door element closes the opening face and a retainer resiliently supports rims of the precision substrates;

a fit-holding portion which is formed by notching either a front inner periphery of the opening face of the container main body or an outer peripheral side of the door element, wherein the sealing element comprises:

an endless portion to be fitted into the fit-holding portion;

a flexible protruding part projected from the endless portion, obliquely and outwardly, and a plurality of fitting ribs formed on at least one side of the endless portion so as to have a press-contact within the fit-holding portion and projected higher by 1 to 25% than the width of the fit-holding portion;

wherein an angle of the protruding part, with respect to a line from the outer periphery of the endless portion to the open front of the container, is selected so that when a load is applied thereto in a direction toward the container main body, the sealing element flexes such that a curved portion of the protruding part contacts a contact surface of the container main body or a contact surface of the door element as a result of the protruding part being formed so that is only bends in the direction of attachment of the door element instead of being compressed in the direction of the attachment of the door element;

wherein the container main body, the door element and the protruding part are constructed and oriented with respect to one another so that when the internal pressure of the container main body closed by the door element becomes higher than the external pressure, air is released from the interior of the container main body to the outside, while the internal pressure of the container main body closed by the door element becomes lower than the external pressure, the outside air is prevented from entering the main container body;

wherein the angle of the protruding part is selected so that when the load is applied, the protruding part is prevented from flexing in a reverse direction inward toward the endless portion.

2. The hermetic container according to claim 1, wherein the sealing element is formed using a fluororubber composition.

3. The hermetic container according to claim 1, wherein among the plurality of fitting ribs, the fitting rib located closest to an entrance into the fit-holding portion is higher than those located within an interior section of the fit-holding portion.

4. The hermetic container according to claim 1, wherein at least a length of the protruding part is set curved inwardly in a direction of squeezing and towards the opening face of the storage container so that the curved portion of the protruding part comes into contact with the contact surface of the container main body or the contact surface of the door element.

* * * * *